United States Patent [19]

Baitz et al.

[11] Patent Number: 4,637,326

[45] Date of Patent: Jan. 20, 1987

[54] MONEY BOX ARRANGEMENT

[75] Inventors: Guenter Baitz; Wilfried Dobring, both of Berlin, Fed. Rep. of Germany

[73] Assignee: Nixdorf Computer AG, Fed. Rep. of Germany

[21] Appl. No.: 717,418

[22] Filed: Mar. 29, 1985

[30] Foreign Application Priority Data

Mar. 29, 1984 [DE] Fed. Rep. of Germany ..... 3411686

[51] Int. Cl.[4] ..... E05G 1/00

[52] U.S. Cl. ..... 109/49; 109/51; 109/52; 109/53; 206/0.83

[58] Field of Search ..... 109/45, 49, 51, 52, 109/53; 220/210, 23; 206/461, 0.82, 0.83

[56] References Cited

U.S. PATENT DOCUMENTS

| | | | |
|---|---|---|---|
| 1,396,361 | 11/1921 | Davidson | 206/0.83 |
| 2,465,057 | 3/1949 | Brandes | 109/51 |
| 3,285,681 | 11/1966 | Niederer | 206/0.83 |
| 4,462,317 | 7/1984 | Franko et al. | 109/45 |

*Primary Examiner*—William F. Pate, III
*Assistant Examiner*—John Malcolm White
*Attorney, Agent, or Firm*—Krass & Young

[57] ABSTRACT

A money box arrangement particularly for use in the cashier's stations of department stores, on bank counters or the like is proposed. This money box arrangement in particular will make possible a simple and secure carrying of the money between the cashier's station and a central cash office. It comprises a cash insert (10) which can be taken out of the cashbox (4) of a cash register (2), a portable strongbox (12) for receiving the cash insert (10) as well as other reserve money not located in this place, and moreover comprises a cover (14) which can serve for closing off the cash insert (10) and for closing off the portable strongbox (12). This arrangement makes it possible for the change in the cash insert (10) and the reserve money to be carried securely between the cashier's station and the central cash office. Since the reserve money is generally accounted for every night but the change can be stored without accounting for the next day, the further capability exists of closing off the cash insert (10) containing the change with the lid (10) and storing this unit, which is substantially smaller than the portable strongbox (12), in the night safe.

5 Claims, 4 Drawing Figures

MONEY BOX ARRANGEMENT

TECHNICAL FIELD

The invention relates to a money box arrangement of the type used at cashier's stations in banks, department stores, and the like.

BACKGROUND OF THE INVENTION

Cashier's offices of large department stores, bank counters or the like are generally all organized in the same way. At the start of the business day the cashier at a central cash office receives a certain amount of loose change, i.e. coins as well as bills, as well as further reserve money which consists of bundles of bills and/or coins gathered in rolls. At the end of the business day the cashier brings the cash box contents, which in turn consist of a certain amount of change as well as reserve money gathered into bundles or rolls, for accounting in the central cash office.

It is often customary for the cashier to make use of a separate money box for carrying the money from the central cash office to the cashier's station and back, which money box may receive the change and the reserve money in a common compartment or in separate compartments. At the cashier's station the change is then sorted out in the cash box, while the reserve money generally remains in the money box. At night the money located in the cash box is placed in the money box and brought to the central cash office. This operation is laborious and insecure, since the transfer from the money box into the cash box and back requires some time and since money can be lost during this operation. Moreover whenever the cashier leaves his cashier's station it is at least necessary to take the money box containing the reserve money with him or lock it, since otherwise this is exposed to access by a third party. A money box arrangement is already known in which the cash box itself serves at the same time as a money box for carrying the money between the cashier's station and the central cash office (prospectus of the firm of ADS Anker GmbH, No. 40-020,7/83). In this solution the cash box is structurally separate from the cash register and connected with this only through control lines. It takes the form of a closable cash box the cover of which is operated by a closing and opening mechanism controlled by the cash register. In this cash box a cash insert can be suspended for receiving the coins, where below this coin insert there is space remaining for receiving bills. For carrying to the central cash office, the control line, which for example is connected by a plug with the cash box, is released, so that the whole cash box can be pulled out. A disadvantage of this arrangement is that the cash box, because of its construction, which also includes the closing and opening mechanism for the cover, is very heavy. A further disadvantage is seen in that generally each cashier has his own portable money box, which is accessible only to him by his personal key, since at least the change need not be accounted for each day but remains overnight in the cashier's portable money box. This means that in this known solution each cashier must have his own money box assigned to him, which is expensive by reason of the closing and opening mechanism as well as the related control elements. Besides this, the known cash box is large and bulky; since the cash boxes, because of the change remaining in them, must be kept in a night safe, a large safe space is required, especially in large department stores with a number of cashiers partially employed in shifts.

SUMMARY OF THE INVENTION

It is the task of the invention to create a money box arrangement of the type of the species which is simple and inexpensive in construction and secure in handling and which requires the smallest possible space for night storage as compared with the known solution.

According to this invention, the cash box proper is a permanent component of the cashier's station or of the cash register, so that this expensive component respectively need be provided only in numbers corresponding to the numbers of cashier's stations, not to the number of cashiers. For carrying the money from the cashier's station to the central cash office, the cashier takes the cash insert out of the cash box and places it in the portable strongbox belonging to him, which also contains the reserve money, places the cover on it and locks it with his personal key. In the central cash office he takes out the cash insert with the change, which is not to be accounted for, closes it with its cover and deposits this small compact container in the night safe; the reserve money, which is gathered into bundles or rolls and is easily accounted for, and for which the most part consists of the day's intake, is delivered to the central cash office so that the portable strongbox is empty and can be kept at any desired place. The next morning the cashier takes out his personal cash insert, places it in any desired portable strongbox and, after placing the reserve money in it, closes both with his personal cover.

In one development of the invention it is provided that the portable strongbox is made as a box open at the top and that the cash insert showing a lower height than the portable strongbox can be inserted in the portable strongbox in such a way that a space remains under the cash insert for receiving the reserve money. For this purpose supporting brackets are provided in the portable strongbox, spaced apart from its bottom, on which the cash insert is placed. The cash insert is preferably made as a tray open at the top, the upper edge of which lies against the inner upper edge region of the portable strongbox on substantially its whole periphery. The cash insert accordingly closes off the space serving for receiving the reserve money in the manner of a lid; the cash insert in turn is closed off by the cover proper of the arrangement, closed off at least in the region of the coin compartments, so that both money spaces are separated from one another and the change and the reserve money cannot become mixed together, even for example by shaking in carrying it or the like.

In a further development of the invention it is provided that the cover shows an edge which is bent downward substantially over its whole periphery, which edge outwardly overlaps the upper edge region of the cash insert, and in that the outer contour of the cover edge is substantially flush with the outer contour of the portable strongbox. The portable strongbox together with the lid forms a visually attractive smooth article without disturbing projections.

In order to make the portable strongbox secure at the cashier's station after the removal of the cash insert from the strongbox containing the reserve money, it is provided in a further development of the invention that locking means are provided on the portable strongbox which interact with locking means provided at a predetermined repository for the purpose of fastening the portable strongbox onto the repository. These locking means according to the invention comprise an approximately mushroom-shaped pin arranged on the repository and projecting inward through the bottom of the portable strongbox, as well as a shackle or the like arranged movably on the inside of the bottom of the portable strongbox and engaging under the head of the pin in its closed position. Since the shackle is arranged in the inside of the portable strongbox which can be closed by the cover, it itself need not be lockable by a key.

Further advantages and features of the invention are seen from the patent claims, the drawings and the description of the drawings. One embodiment of the invention is represented in these drawings and described in detail in the following. In these:

BRIEF DESCRIPTION OF THE PREFERRED EMBODIMENT

Figure 1:
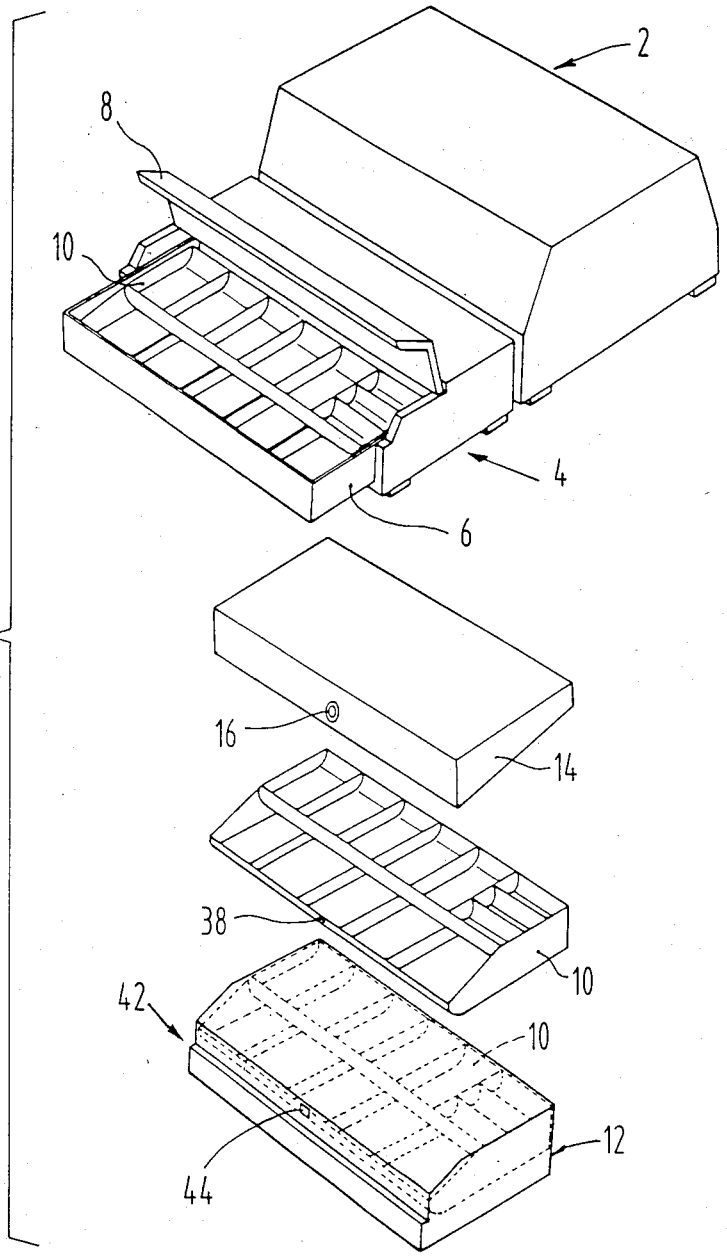
FIG. 1 in a perspective representation shows the individual components of the whole arrangement.

FIG. 1 shows a conventional cash register 2 with a cash box 4 assigned to this. This consists of a drawer 6 which is normally pushed into the case of the cash box 4 and is closed by a cover 8. For a cashier's transaction, the drawer 6 can be made accessible by moving it out at least part of the way as well as by opening the lid 8, as is represented in FIG. 1.

In the drawer 6 there is a cash insert 10 which is divided suitably into separate compartments for receiving paper money and coins. This cash insert can be taken out of the drawer 6 for the purpose of carrying it and be placed in a portable strongbox 12. In FIG. 1, below, the cash insert 10 is represented in broken lines. In the interior of the portable strongbox 12, supporting brackets 54 (FIG. 2,4) are mounted on its side walls, on which brackets the cash insert is supported. Under the cash insert 10 inserted in the portable strongbox 12 a space remains for receiving reserve money which for example is gathered into bundles or rolls.

The portable strongbox 12 can be closed off by a cover 14 which can be placed on this. A lock 16 serves for the antitheft locking of the cover 14.

As is seen particularly in FIG. 1, below, the upper edge of the cash insert 10 lies against the inner upper edge region of the portable strongbox 12 on substantially its whole periphery, so that the opening of the portable strongbox is closed off by the cash insert. Since the opening contours of the portable strongbox 12 and of the cash insert 10 are substantially congruent in this manner, the cover 14 can also serve for closing off the cash insert 10, as was already described.

Figure 2:
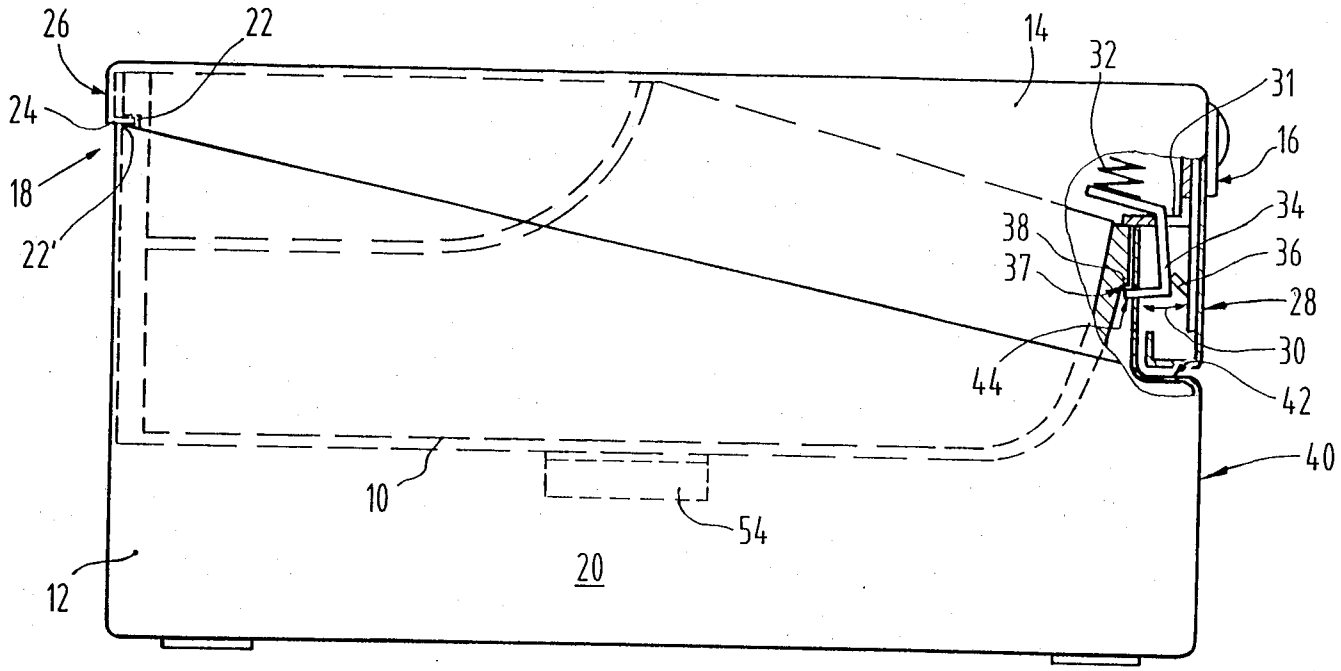
FIG. 2 in a lateral sectional representation shows a portable strongbox with the cash insert inserted as well as the cover placed on it.

As can be seen from FIG. 2, the cash insert on its outer back side is provided with openings 22 which are in alignment with openings 22' formed on the upper edge region 18 of the portable strongbox 12 when the cash insert 10 is in the portable strongbox 12. Projections 24 formed on the rear cover edge 26 penetrate through the openings 22' and engage in the openings 22.

The front cover edge 28 in its cross section has approximately the profile of an open box. Thereby on the one hand the strength of the lid is increased, and on the other hand this box also serves for accommodating the lock 16. This comprises a locking bar 34 which is supported in an opening in a supporting angle iron 31 to be pivotable in the direction of the arrow 30 and is spring-loaded in the opening direction by a pressure spring 32, which bar can be forced into its closed position by a closing lever 36 operated by a key, as need not be discussed in detail. The supporting angle iron 31 is placed with its first side on the inside of the front cover edge 28 in such a way that its second side runs parallel to the upper covering face of the cover 14. With the cover 14 placed on the portable strongbox 12 the second side of the supporting angle iron 31 is supported on the front upper edges of the portable strongbox 12 and of the cash insert 10. The locking bar 34 in its closing position catches under a projection 37 provided on the front side of the cash insert 10 which projection is formed by a lug 38 projecting out of the front side.

The front wall 40 of the portable strongbox 12 is provided with a step 42 offset inward, the depth of which corresponds approximately to the depth of the box profile of the front cover edge 28. This shaping makes it possible to make the outer contour of the cover 14 aligned with the wall of the portable strongbox 12 in its region of overlapping with the wall of the portable strongbox 12.

Figure 3:
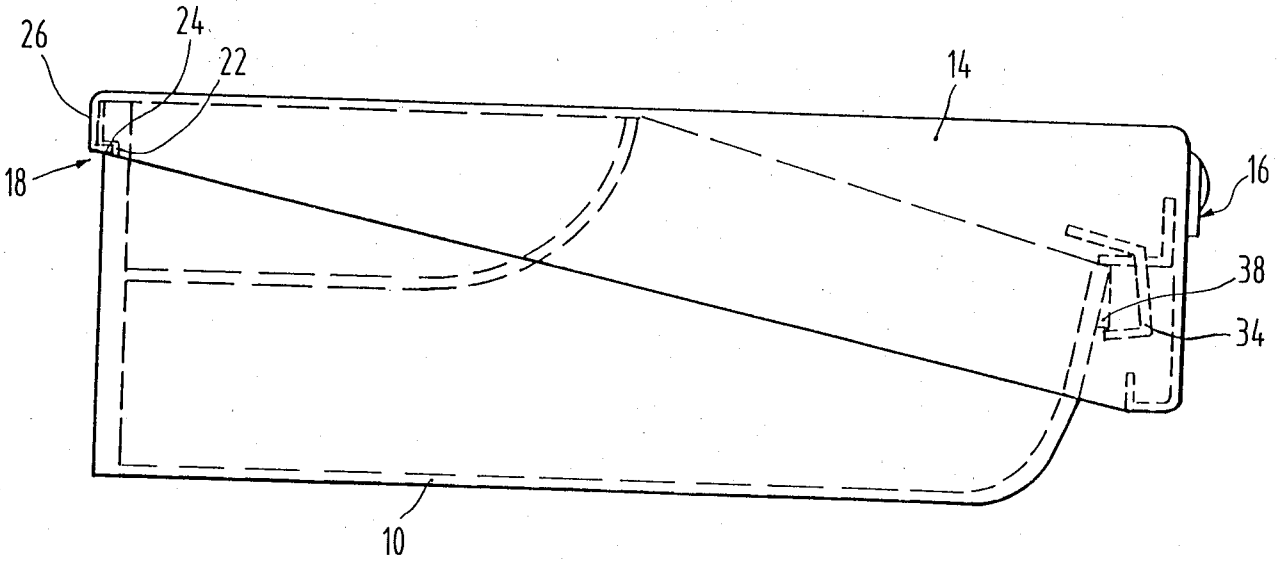
FIG. 3 shows a cash insert according to FIG. 2 with the cover placed on it.

As FIG. 2 further reveals, the locking bar 34 grips through an opening 44 formed in the front wall 40 of the protable strongbox 12 and in this manner also locks the cover 14 to the portable strongbox 12. Accordingly, the cover 14 can be used for closing off the portable strongbox 12 alone, for closing off the portable strongbox with inserted cash insert 10 as well as for closing off the cash insert 10 alone. This latter configuration is represented in FIG. 3, in which the same parts as in FIG. 2 are designated with the same reference numbers.

Figure 4:
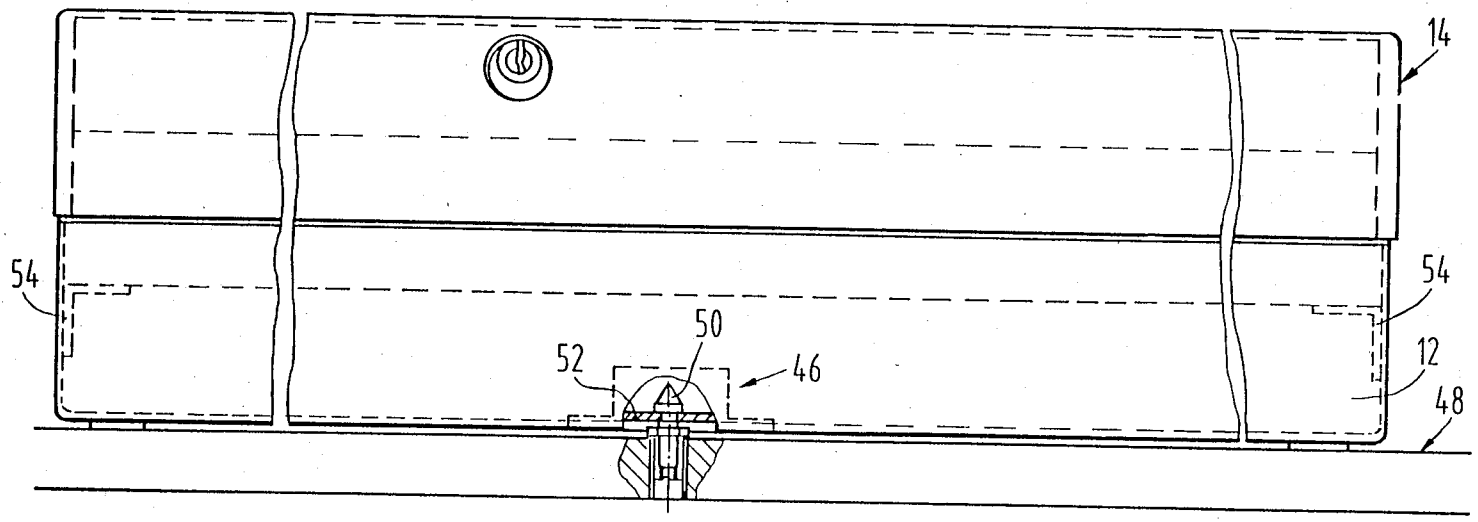
FIG. 4 shows a partly sectional front view of a portable strongbox according to FIG. 2 with a representation of the locking means.

FIG. 4 in a front view shows the portable strongbox 12 with the cover 14 placed on. Locking means 46 serve for securing the portable strongbox 12 on its assigned repository 48. These comprise on the one hand an approximately mushroom-shaped pin 50 protruding out from the repository surface 48 and projecting inward through the bottom of the portable strongbox 12, as well as on the other hand a shackle 52 arranged movably on the inside of the strongbox bottom which in a closed position catches under the head of the pin 50, but in an open position releases this head. Since the shackle 52 is arranged in the interior of the portable strongbox 12, it can be operated only after the removal of the lockable cover 14, so that no special lockable bolting for this shackle is required.

We claim:

1. A cashbox assembly comprising:

a strongbox comprising the integral combination of a bottom, a rear wall, opposite side walls and a front wall;

a cash drawer insert comprising the integral combination of a bottom, a rear wall, opposite side walls and a front wall, the cash drawer insert overall being of lesser dimension than said strongbox to fit within said strongbox;

means disposed on the interior surfaces of the strongbox side walls to receive said insert and hold said insert within the upper interior volume of said strongbox with the rear wall of said insert abuttingly adjacent the interior surface of the strongbox rear wall and with the front wall of the insert adjacent the interior side of the front wall of the strongbox;

cover means for optionally covering the insert, the strongbox, and the combination of the insert and the strongbox, said cover comprising the integral combination of a top, a rear wall and a front wall;

openings formed respectively in the front and rear walls of the strongbox;

connector means on the rear wall of the cover projecting through the opening in the rear wall of the strongbox and into interfering relationship with the rear wall of the insert to secure said cover to the strongbox and to the insert within said strongbox; and latch means mounted on the front wall of the cover including a latch bar which, in a latched position, extends through the opening of the front wall of the strongbox into interfering relationship with the front wall of the insert to inhibit relative movement between the cover of the strongbox and the insert.

2. Apparatus as defined in claim 1 wherein said means disposed on the interior surfaces of the strongbox side walls are spaced upwardly from the bottom of the strongbox thereby to space the bottom of the insert upwardly from the bottom of the strongbox when the insert is placed within said strongbox.

3. Apparatus as defined in claim 1 wherein the front wall of the strongbox has formed integrally thereon an inwardly extending top flange and the front wall of the cover has formed integrally thereon an inwardly extending bottom flange, the top flange of the strongbox front wall and the bottom flange of the cover front wall meeting in abuttingly adjacent relationship when the cover is in place and latched on said strongbox to form a flush front surface consisting conjointly of the front walls of the cover and the strongbox.

4. Apparatus as defined in claim 1 further including means disposed in the bottom wall of said strongbox to receive a depository lock therethrough.

5. Apparatus as defined in claim 1 wherein the cover means also has opposite side walls; said cover means closely conforming in configuration to said insert.

* * * * *